United States Patent [19]

Carey-Yard

[11] Patent Number: 4,794,697

[45] Date of Patent: Jan. 3, 1989

[54] VOID/LIFT METER

[75] Inventor: Andrew S. Carey-Yard, Surey, England

[73] Assignee: Kango Wolf Power Tools Limited, London, England

[21] Appl. No.: 94,590

[22] Filed: Sep. 9, 1987

[30] Foreign Application Priority Data

Sep. 10, 1986 [GB] United Kingdom ..... 8621826

[51] Int. Cl.[4] ..... G01B 5/18

[52] U.S. Cl. ..... 33/1 Q; 33/169 R; 33/172 R

[58] Field of Search ..... 33/169 R, 172 R, 1 Q; 238/2, 1, 7

[56] References Cited

FOREIGN PATENT DOCUMENTS 1370076 10/1974 United Kingdom ..... 33/1 Q

*Primary Examiner*—L. T. Hix
*Assistant Examiner*—Brian W. Brown
*Attorney, Agent, or Firm*—Wenderoth, Lind & Ponack

[57] ABSTRACT

There is provided a void/lift meter (10) comprising a shaft (14) extending from a base member (13) and a bracket (16) having a claw portion (22) and upper and lower portions (17),(18) disposed on said shaft for axial movement therealong. An arm (24) is slidably mounted in said bracket and is formed with a second claw portion (27) at one end which portion is biased towards said first claw portion (22) for clamping therebetween a rail. Between the upper and lower portions (17),(18) is a collar which is a friction fit on said shaft. The meter is used to measure the void under a railway sleeper and to ensure that the track is jacked up to the correct height to allow extra ballast to be introduced under the sleeper.

10 Claims, 4 Drawing Sheets

VOID/LIFT METER

Figure 1:
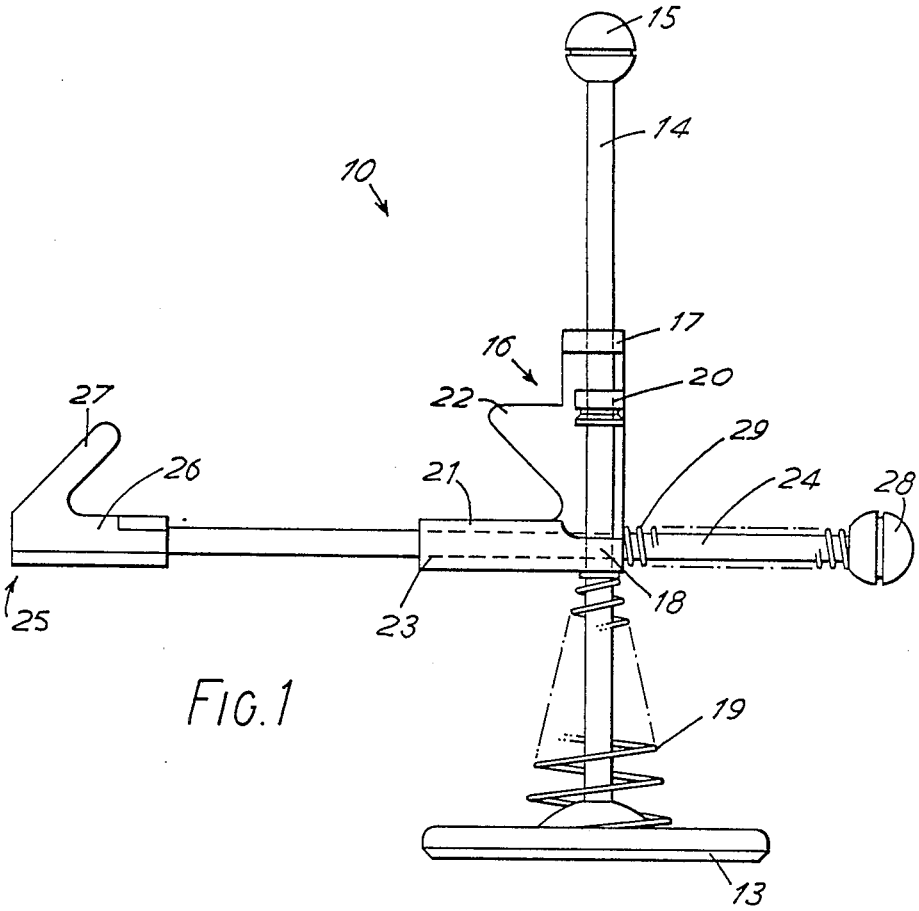

This invention relates to a void/lift meter and more particularly to a void/lift meter for measuring the void beneath a section of railway track. In a known method of filling such voids the contents of packages of ballast are scattered under the sleeper, the contents of each package being arranged to raise the sleeper by a predetermined distance, e.g. 1.6 mm or 1/16".

According to the present invention there is provided a void/lift meter for determining the void beneath a sleeper supporting a rail comprising a substantially vertical shaft extending from a base member characterised in that there is provided, an arm for extending under the rail said arm being adapted for releasable attachment to the rail and being mounted on a bracket disposed on said shaft for movement lengthwise thereof, which bracket has an upper portion and a lower portion spaced below said upper portion, and a slider member slidably mounted on the shaft between said two portions which slider member is self-retaining due to friction in an position along the length of the shaft, said upper and lower portions being adapted and arranged to engage the slide member from above add below respectively, said bracket being capable of lost motion with respect to the slider member, and said two portions being spaced apart so that the sum of the lengths of shaft exposed between said two portions and the slider member has a predetermined value.

Thus in use of the void/lift meter, the slide member is moved into engagement with said upper portion of tee bracket so that, under load, depression of the rail due to the void beneath the sleeper moves the bracket down the shaft and the upper portion of the bracket in turn moves the slider member down the shaft. The subsequent return of the rail to its initial higher position moves the bracket back up the shaft whilst the slider member remains in its depressed position on the shaft. The distance between said upper portion and said slider member is the height of the void and is measured. The rail is then jacked up so that the lower portion touches the underside of the slider collar. The void beneath the sleeper is now equal to said predetermined value to allow a quantity of ballast dependent on the height of said void as originally measured to be introduced beneath the sleeper.

In a preferred embodiment means are provided which enable the distance between the upper portion of the bracket and the slider collar to be read off.

Conveniently said means comprises a scale mounted on the bracket and a pointer pivotally mounted on the slider member, an elongate slot and a pin engaged therein being provided one on the scale and one on the pointer so that relative movement between the bracket and the slider member causes the pointer arm to move with respect to the scale.

Preferably said bracket is formed with a first claw portion and said arm has a second claw portion which is spring loaded towards said first claw portion for clamping a bottom flange of the rail between the two claw portions.

In a preferred embodiment said arm is slidably mounted in a bore extending through said bracket so as to be substantially perpendicular to said vertical shaft, a spring being disposed between said bracket and the other free end of said arm to bias said second claw portion towards said first claw portion.

Preferably a second spring is disposed about the shaft between the base member and the bracket to bias the bracket away from the base member.

Figure 3:
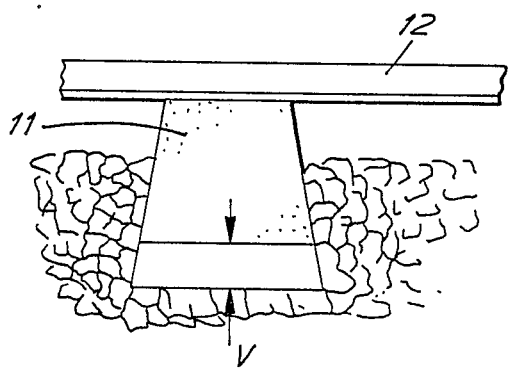
Figure 2A:
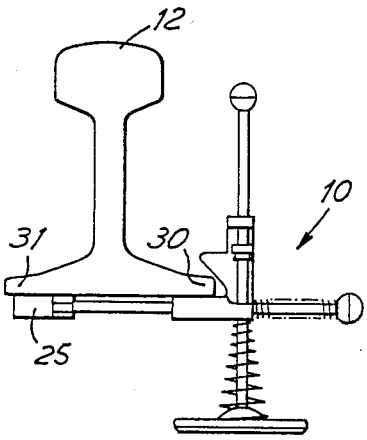
Figure 2B:
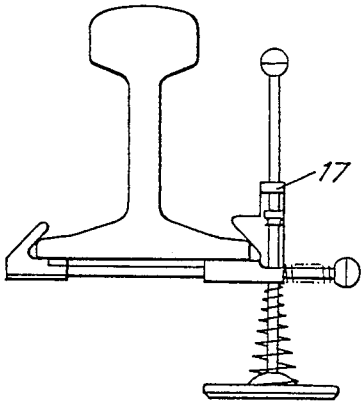
Figure 2C:
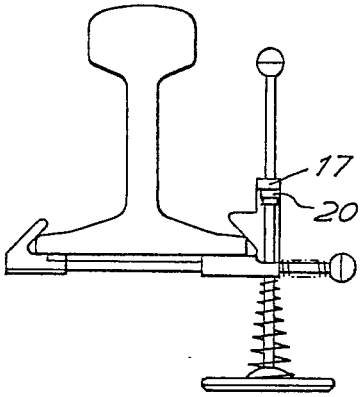
Figure 2D:
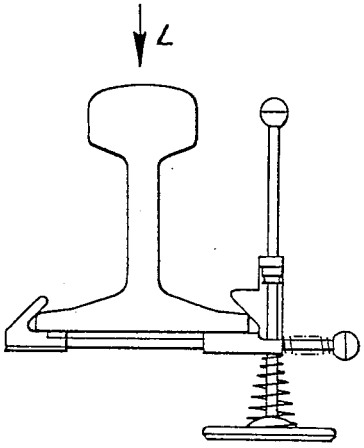
Figure 2E:
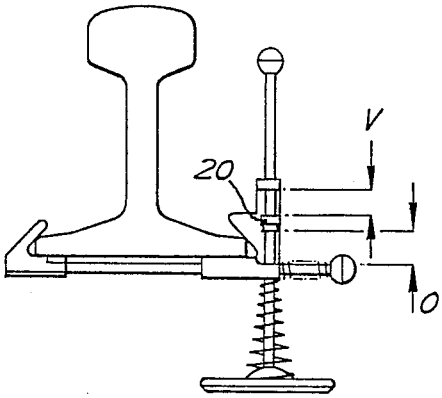
Figure 2F:
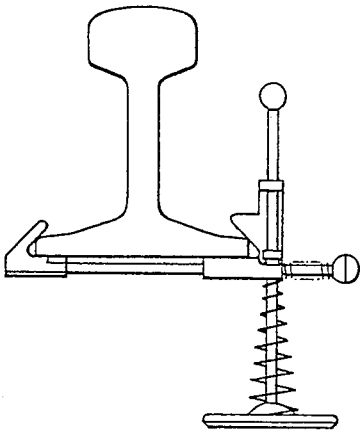
Figure 4A:
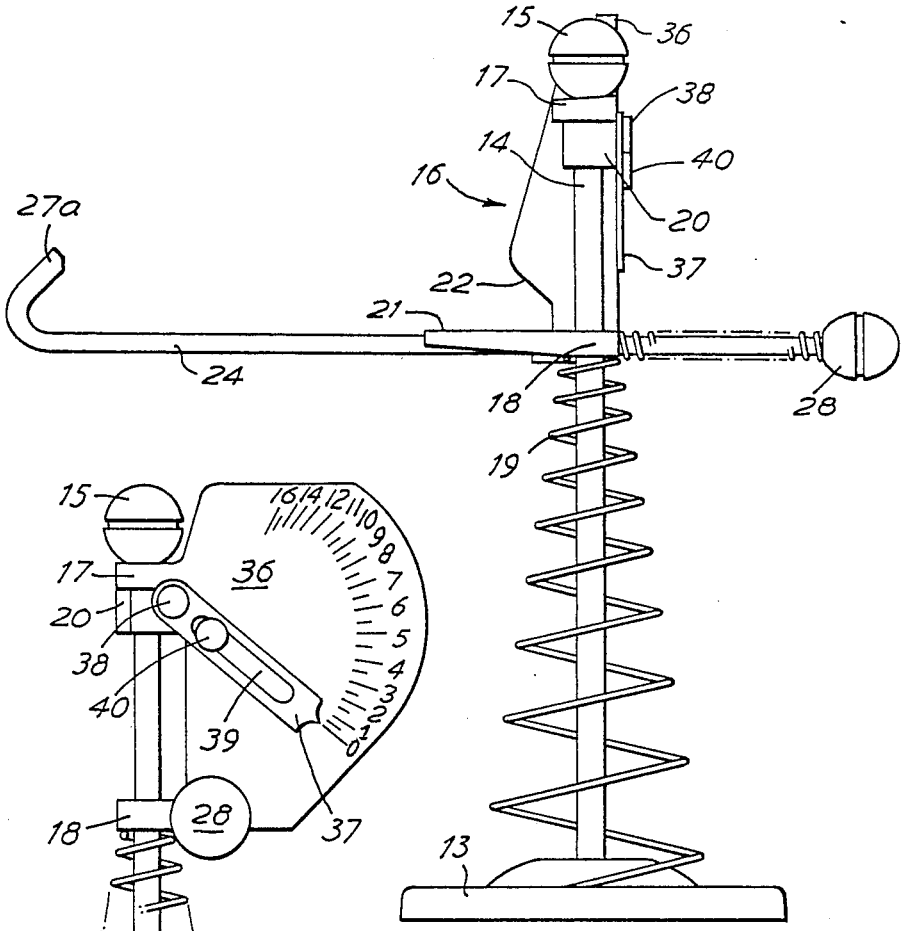
Figure 4B:
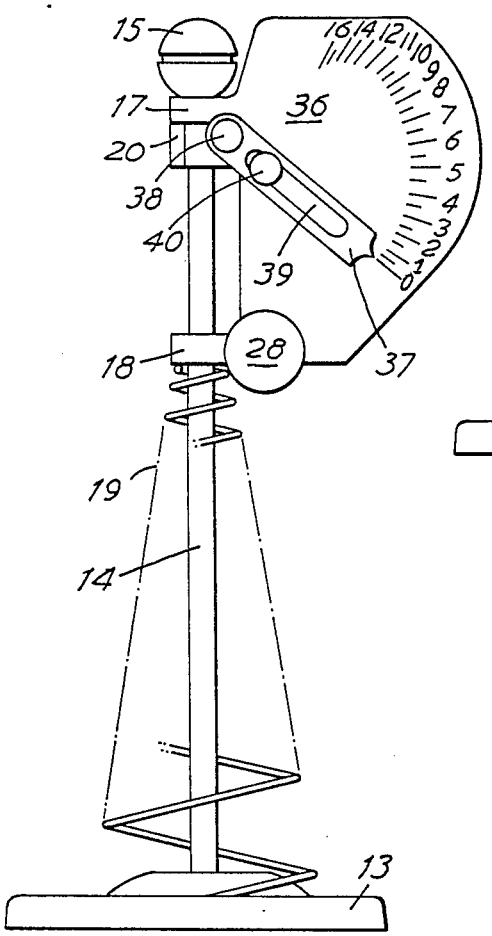
Figure 5:
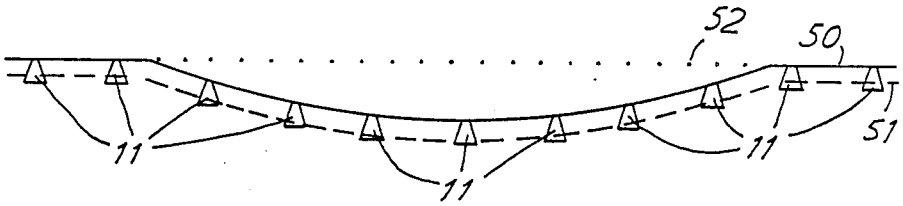

The invention will now be described in more detail. The description makes reference to the accompanying diagrammatic drawings in which:

FIG. 1 is a side view of a void/lift meter according to the invention,

FIG. 2(*a*) to 2(*f*) shows the void/lift meter of FIG. 1 in various stages of use, FIG. 3 shows a sleeper and a rail to which the meter of FIG. 1 is applied, FIGS. 4*a* and 4*b* are respectively side and front views of a modified void/lift meter according to the invention, FIG. 5 shows a section of depressed track on an exaggerated scale.

Figure 6:
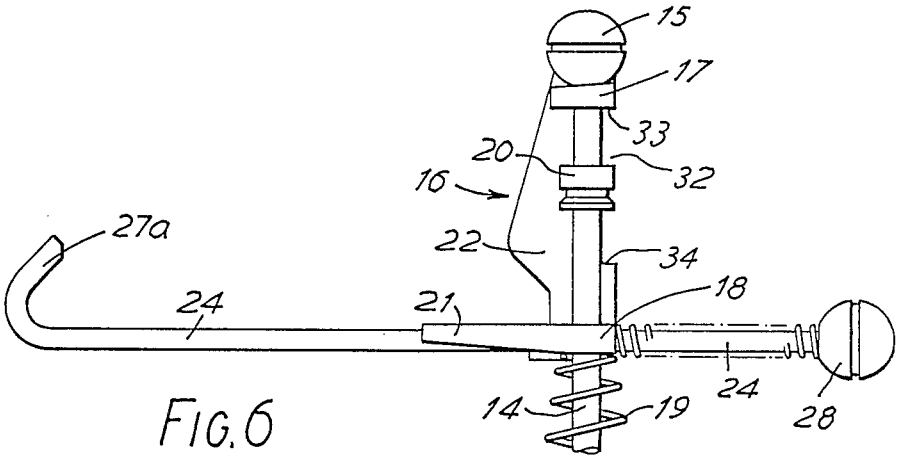
Figure 7A:
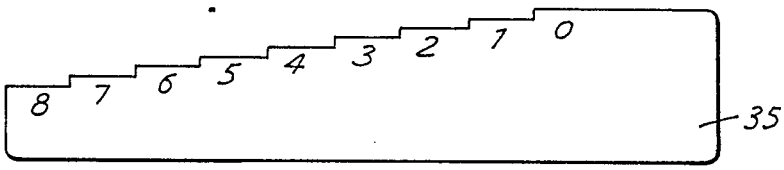
Figure 7B:
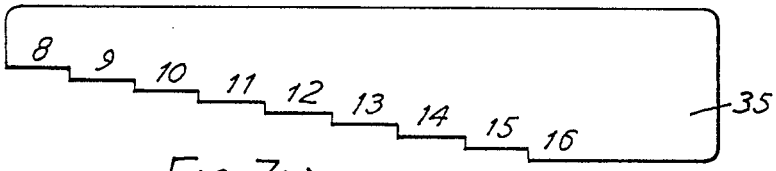

FIG. 6 is an alternative form of bracket and rod according to the invention, and FIG. 7(*a*) and FIG. 7(*b*) show front and rear faces of a taper gauge for use with the bracket shown in FIG. 6.

In the Figures there is shown a meter 10 for measuring the void beneath a sleeper 11 located under a length of rail 12.

The meter comprises a base member 13 and a substantially vertical shaft 14 extending upwardly therefrom and terminating in a carrying knob 15. Mounted on the shaft 14 is a bracket 16 having an upper portion 17 and a lower portion 18 disposed about the shaft for axial sliding motion along the shaft. A spring 19 is disposed about the shaft between the bracket and the base member to bias the base 13 downwardly into firm engagement with the bed of ballast supporting the sleepers. A slider member in the form of a friction fit indication collar 20 having an internal O-ring is disposed about the shaft between said upper and lower portions of the bracket. The bracket has a substantially flat horizontal portion 21 for abutting the underside of the rail 12 and has a claw portion 22 for positively engaging an edge portion of the rail 12.

Extending below the flat portion 21 of the bracket is a straight horizontal through bore 23 through which extends a rod 24 which is capable of sliding axially of the bore 23 and of rotating about the lengthwise axis of the bore 23. On one end of the rod 24 is secured a rail support 25 comprising a flat portion 26 and a claw portion 27 for co-operation with portions 21, 22 of the bracket to securely grip the rail. On the other end of the rod 24 is a knob 28 and a second spring 29 is disposed about the rod 24 between the bracket 16 and the knob 28 to bias the claw portion 27 towards the claw portion 21 of the bracket 16.

FIGS. 2(*a*) to 2(*f*) show the step-by-step operation of the void/lift meter to measure the void beneath the sleeper 11. For convenience it is assumed that the track in an unloaded state is in its correct attitude but has voids beneath the sleepers, for example the track is level over a section of track which is intended to be level. In FIG. 2(a) the meter is shown being positioned, the rail support 25 having been rotated through 90° from the position shown in FIG. 1. The rod 24 and the rail support 25 are manoeuvred underneath the rail 12 so that one edge 30 of the rail base is engaged between the claw and flat portions 21, 22 of the bracket and the base member has a secure grounding ensured by the action of the spring 19. The rod is then pushed against the force of the spring 29 so that the claw portion 27 is clear of the other edge 31 of the rail base. The rod is then rotated through approximately 90° to bring the claw portion 27 into similar orientation as portion 22 and the rod is released. The force of the spring 29 causes the claw portion 27 to engage the edge 31 of the rail to which rail the meter is now securely but releasably 5 attached, as shown in FIG. 2(*b*).

In FIG. 2(*c*) the indication collar 20 has been moved up the shaft until it abuts the underside of the upper portion 17. When a load L such as a train or a weight corresponding to that of a train is applied to the rail as shown in FIG. 2(*d*) the void beneath the sleeper 11 allows the sleeper and the rail to move downward under the load. The bracket 16 is thus moved down the shaft by the load and the upper portion 17 of the bracket consequently moves the collar 20 down the shaft.

When the load is removed as shown in FIG. 2(*e*) the rail 12, the sleeper 11 and the bracket return to their original positions but the indication collar 20 remains in the position it was moved to by the action of the load. The void beneath the track can therefore simply be measured as the distance V between the collar 20 and the upper portion of the bracket 16.

The modified bracket and rod shown in FIG. 6 are provided with means for aiding the measurement of the void, those elements corresponding to similar elements in the FIG. 1 construction being given corresponding reference numerals. No rail support 25 is provided but the rod 24 is bent at its free end to constitute a claw 27*a*. The means for aiding measurement comprises a cutaway section 32, the top extremity of which is level with the lowermost face of the upper portion 17 of the bracket and the lower extremity 34 of which is at a distance below the top extremity 33 equal to 1 inch (25.4 mm) plus the vertical height of the collar 20. This recess allows a taper gauge 35, as shown in FIG. 7, to be used to calculate the height of the void V as indicated by the disposition of the collar 20 with respect to the upper portion 17 of the bracket. The gauge 35 is 1 inch (25.4 mm) high at one side and is formed with a series of steps each of which is 1/16 of an inch high so that the other side of the gauge is ½ of an inch high. The steps are numbered 0 to 8 on one face and 8 to 16 on the reverse face. (The significance of the size of the recess and the gauge is explained later but, in brief, if the void is greater than 1 inch then the track is generally considered unsafe. It will therefore be appreciated that 1 inch is an arbitrary figure, and depends on the safety requirements of the track.)

The cutaway section 32 is such that for voids up to ½ inch (12.7 mm) in height the gauge, orientated as shown in FIG. 7(*a*), is inserted between the collar 20 and the lowermost extremity 34. The void height is read off according to the step which is engaged by the collar 20, for example 5/16 (7.9 mm). For voids in the range ½ to 1 inch the gauge is inverted as shown in FIG. 7(*b*) and inserted between the upper extremity 33 of the section 32 and the collar 20. Again the void height is read off according to the step which is engaged by the collar, for example 11/16 inch (17.5 mm).

It is preferred procedure in railway track maintenance to jack the rail up as shown in FIG. 2(*f*) thereby increasing the void beneath the sleeper 11 so that the total height of the void has a predetermined value of approximately 40 mm which is equal to the nominal diameter of the main support ballast. This distance may vary according to the size of the main support ballast, but is the maximum void which can exist below the sleeper without risk of the adjacent main support ballast falling under the sleeper and thus upsetting the calculations for the required amount of additional ballast. The distance between the upper portion 17 and the lower portion 18 of the bracket minus the depth of the collar 20 itself is therefore made to be 40 mm. The track is then jacked up so that the lower portion 18 just abuts the underside of the collar 20 thereby ensuring that a total void of 40 mm exists beneath the sleeper 11. The track is thus jacked up by a distance 0 equal to 40 mm - V, and this distance is termed the overlift.

The jacking up to make a void of 40 mm allows additional ballast of nominally 20 mm diameter to be introduced into the void beneath the sleeper by blowing stone chips under the sleeper on an air current. The amount of ballast introduced depends on the size of the void V as originally measured and is predetermined according to the height of the void. After the ballast has been introduced the jacks are removed and the track allowed to settle.

In cases where the main support ballast has a smaller nominal diameter than 40 mm or where it is not possible to jack the track up enough to produce a total void o 40 mm for example at switch and crossings, then a limiting collar of 5 mm depth is clipped onto the shaft in a position resting on the lower portion 17 of the bracket. The amount of possible overlift is therefore reduced by 5 mm so that on jacking up of the track, the total void beneath the sleeper is 35 mm. In both cases it is difficult and unnecessary to introduce 20 mm ballast but the 35 mm void enables a smaller nominal diameter ballast, say 14 mm, to be introduced into the void beneath the sleeper.

The above method would in practice be conducted over a section of track having say eight sleepers with two meters being used for each sleeper, one per rail.

A more sophisticated embodiment of the meter is shown in FIGS. 4*a* and 4*b* is used in the main for correcting a section of track 50 which has become depressed as shown in FIG. 5, in addition to having voids under the sleepers. Indeed it is generally the case that a depressed section of track will have voids beneath the sleepers and similarly a section of track having voids beneath the sleepers will also be depressed.

The meter shown in FIGS. 4*a* and 4*b* is similar to that shown in FIG. 6 except that a scale 36 is mounted on the bracket 16 and a pointer 37 is pivotally attached at 38 to the collar 20. The pointer 37 is formed with an elongate slot 39 in which a pin 40 attached to the scale 36 is engaged. The arrangement is such that the pointer reads zero on the scale when the collar is positioned against the upper portion 17 of the bracket.

A series of void/lift meters are connected to the rail at positions adjacent the sleepers along said depressed section of track and the collars 20 of the meters are positioned against the respective upper portions 17 so that each pointer 37 reads zero on its associated scale 36.

When a train passes over the section of track 50, the collar 20 of each meter is moved down as the track is depressed due to the voids beneath the sleepers to the broken line 51 shown in FIG. 5. After the train has passed, the track and the brackets return to their original positions as described above in relation to FIG. 1 but the collars 20 remain depressed. The pointers 37 thus give the visual display of the exact size of the voids beneath the respective sleepers.

The unloaded track 50 is then jacked up until the track is level along the section as shown by the dotted line 52 in FIG. 5. This movement of each bracket upwards thus causes the pointer to indicate a greater void beneath the sleeper 11 according to the depression of the track at the position of the meter in question. The voids shown on the scales at this stage indicate the amount of ballast which needs to be introduced beneath the respective sleepers in order to produce a substantially level section of track having no voids under the sleepers.

The track is then further jacked up so that for each meter the lower portion 18 of the bracket 16 touches the underside of the collar 20 so that there is now a void of 40 mm beneath the sleeper (which void size has been discussed above in relation to FIG. 1) thereby enabling the predetermined amount of 20 mm ballast to be introduced beneath the sleeper by stone blowing as previously described. When the jacks are removed the track settles to a substantially level position having no voids beneath the sleepers.

If another train wishes to pass over the section of track 50 during say the jacking process or the ballast introduction stage it will be appreciated that the jacks can be removed to allow the train to pass and the original void readings on the meters will not be disturbed. The jacks can subsequently be replaced and the track raised to its original overlift condition without the need for remeasurement of the track.

The scale is non-linear and has a full scale deflection of about one inch (2.54 cms), a track having the sum of the void beneath a sleeper and the height of depression greater than one inch being generally considered too dangerous to run trains on and in all events such a space beneath a sleeper is considered unsuitable for filling by the methods mentioned in this specification.

Furthermore the scale is calibrated and the pin positioned so that the scale is widest and therefore most accurately read over the range of say 0 to 10 sixteenths of an inch (0 to 1.59 cms) which range represents the most common void/depression sum.

It will be appreciated that the spring 19 is ideally a conical spring as shown in FIGS. 1 and 4 because a conical spring can be depressed almost flat to enable the meter to be positioned under a rail which is particularly close to the ground.

Clearly the method of rectifying a depressed section of track is equally suited to the use of void meters having said taper gauge means instead of said scale and pointer means for determining the size of the void and is also equally suited to the use of void meters of the basic type shown in FIG. 1.

Removal of the meter is simply a reversal of the technique used to attach the meter and is therefore not described.

I claim:

1. A void/lift meter for determining the void beneath a sleeper supporting a rail comprising a substantially vertical shaft extending from a base member characterised in that there is provided an arm for extending under the rail said arm being adapted for releasable attachment to the rail and being mounted on a bracket disposed on said shaft for movement lengthwise thereof, which bracket has an upper portion and a lower portion spaced below said upper portion, and a slider member slidably mounted on the shaft between said two portions, which slider member is self retaining due to friction in any position along the length of the shaft, said upper and lower portions being adapted and arranged to engage the slider member from above and below respectively, said bracket being capable of lost motion with respect to the slider member and said two portions being spaced apart so that the sum of the lengths of shaft exposed between said two portions and the slider member has a predetermined value.

2. A meter as claimed in claim 1 characterised in that means are provided which enable the distance between the upper portion of the bracket and the slider member to be read off.

3. A meter as claimed in claim 2 characterised in that said means comprises a scale mounted on the bracket and a pointer pivotally mounted on the slider member, an elongate slot and a pin engaged therein being provided one on the scale and one on the pointer, so that relative movement between the bracket and the slider member causes the pointer arm to move with respect to the scale.

4. A meter as claimed in claim 3 characterised in that the slot is formed in the pointer.

5. A meter as claimed in claim 1 characterised in that said bracket is formed with a first claw portion and said arm has a second claw portion which is spring loaded towards said first claw portion for clamping a bottom flange of a rail between the two claw portions.

6. A meter as claimed in claim 5 characterised in that said second claw portion is constituted by a bent free end of said arm.

7. A meter as claimed in claim 6 characterised in that said arm is slidably mounted in a bore extending through said bracket so as to be substantially perpendicular to said vertical shaft a spring being disposed between said bracket and the other free end of said arm to bias said second claw portion towards said first claw portion.

8. A meter as claimed in claim 7 characterised in that said arm and thus said second claw portion are rotatable about the lengthwise axis of said arm by at least 90° for facilitating positioning under the rail.

9. A meter as claimed in claim 1 characterised in that a second spring is disposed about the shaft between the bracket and the base member to bias the bracket away from the base member.

10. A meter as claimed in claim 9 characterised in that said second spring is a conical coil spring.

* * * * *